US010022729B2

(12) United States Patent
Hartmann et al.

(10) Patent No.: US 10,022,729 B2
(45) Date of Patent: Jul. 17, 2018

(54) METHOD FOR CONTINUOUSLY CLARIFYING A FLOWABLE SUSPENSION WITH A CENTRIFUGE, WHICH INVOLVES A TIME-LIMITED SOLID-MATTER DISCHARGE BY OPENING AND CLOSING SOLID-MATTER DISCHARGE OPENINGS OF THE CENTRIFUGE TO DISCHARGE THE SOLID MATTER

(71) Applicant: GEA MECHANICAL EQUIPMENT GMBH, Oelde (DE)

(72) Inventors: Tore Hartmann, Oelde (DE); Oliver Baumann, Rheda-Wiedenbrück (DE)

(73) Assignee: GEA MECHANICAL EQUIPMENT GMBH, Oelde (DE)

( * ) Notice: Subject to any disclaimer, the term of this patent is extended or adjusted under 35 U.S.C. 154(b) by 139 days.

(21) Appl. No.: 15/030,223

(22) PCT Filed: Oct. 20, 2014

(86) PCT No.: PCT/EP2014/072435

§ 371 (c)(1),
(2) Date: Apr. 18, 2016

(87) PCT Pub. No.: WO2015/059089

PCT Pub. Date: Apr. 30, 2015

(65) Prior Publication Data

US 2016/0271625 A1 Sep. 22, 2016

(30) Foreign Application Priority Data

Oct. 21, 2013 (DE) ..... 10 2013 111 586

(51) Int. Cl.

| | |
|---|---|
| ***B04B 1/14*** | (2006.01) |
| ***B04B 11/04*** | (2006.01) |
| ***B04B 11/05*** | (2006.01) |

(52) U.S. Cl.
CPC ..... *B04B 1/14* (2013.01); *B04B 11/04* (2013.01); *B04B 11/05* (2013.01)

(58) Field of Classification Search
CPC ..... B04B 1/14; B04B 11/04; B04B 11/05
(Continued)

(56) References Cited

U.S. PATENT DOCUMENTS

| | | | | |
|---|---|---|---|---|
| 5,318,500 | A | 6/1994 | Kelley et al. | |
| 2013/0029828 | A1* | 1/2013 | Haggmark | B04B 13/00 494/2 |
| 2015/0045199 | A1* | 2/2015 | Thorwid | B04B 1/08 494/2 |

FOREIGN PATENT DOCUMENTS

| | | |
|---|---|---|
| DE | 2814523 A1 | 10/1979 |
| DE | 3228074 A1 | 2/1984 |

(Continued)

OTHER PUBLICATIONS

Office Action dated Apr. 19, 2017 in related CN Application No. 201480057793.9.

(Continued)

*Primary Examiner* — Walter Dean Griffin
*Assistant Examiner* — Shuyi S Liu
(74) *Attorney, Agent, or Firm* — Patent Portfolio Builders PLLC

(57) ABSTRACT

A method is provided for continuously clarifying a flowable suspension with a discontinuously solid-discharging—self-discharging—separator, which has a rotatable drum with a vertical axis of rotation, a feed for the suspension to be clarified and at least one liquid discharge for continuously discharging at least one clarified liquid phase, and discontinuously openable solid-discharge openings for discontinuously discharging the solid phase. The method involves a) measuring one or more of the suspension parameters mass, mass of solid substance in the suspension, mass flow, (Continued)

Figure 1:
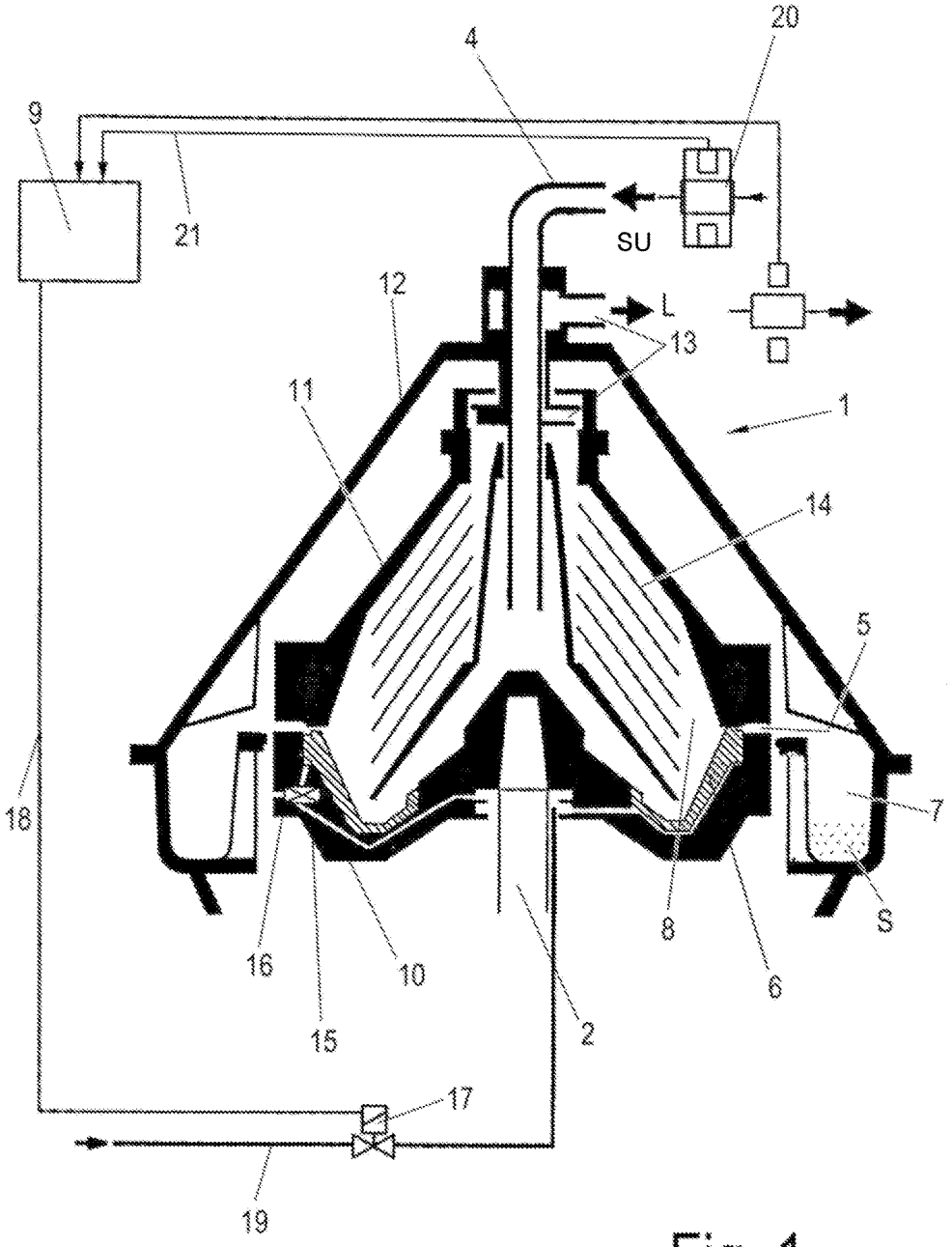

temperature, density, cumulative density; and b) initiating a time-limited discharge of solid substance as a result of a repeated determination on the basis of step a) in the event of or after the exceeding of a limit value.

7 Claims, 2 Drawing Sheets

(58) Field of Classification Search
USPC ..... 494/2, 3, 10
See application file for complete search history.

(56) References Cited

FOREIGN PATENT DOCUMENTS

| | | | | |
|---|---|---|---|---|
| EP | 2644278 | A1 * | 10/2013 | ..... B04B 1/08 |
| GB | 1587853 | | 4/1981 | |
| GB | 2124931 | A | 2/1984 | |
| WO | 2011/093784 | A1 | 8/2011 | |
| WO | WO 2011093784 | A1 * | 8/2011 | ..... B04B 11/02 |

OTHER PUBLICATIONS

International Search Report dated Feb. 3, 2015 in related International Application No. PCT/EP2014/072435.
Written Opinion dated Feb. 3, 2015 in related International Application No. PCT/EP2014/072435.

* cited by examiner

METHOD FOR CONTINUOUSLY CLARIFYING A FLOWABLE SUSPENSION WITH A CENTRIFUGE, WHICH INVOLVES A TIME-LIMITED SOLID-MATTER DISCHARGE BY OPENING AND CLOSING SOLID-MATTER DISCHARGE OPENINGS OF THE CENTRIFUGE TO DISCHARGE THE SOLID MATTER

BACKGROUND AND SUMMARY OF THE INVENTION

Exemplary embodiments of the invention relate to a method for continuously clarifying a free-flowing suspension with a centrifuge.

German patent document DE 32 28 074 A1 discloses a method that advantageously permits control of a continuously emptying clarifying separator having a drum. A suspension parameter—here the level of turbidity of a clear phase running out of the drum—is determined and used to monitor the emptying of the solid-matter chamber of the drum. The solid-matter phase is emptied continuously. If the turbidity in the clear phase becomes too high, the clear phase is led back into the drum.

It is also known to use a clarifying separator for the clarification of liquids, in particular beverages, in which the solid matter is emptied discontinuously with the aid of a piston valve for opening and closing discharge openings if the level of turbidity, measured with the photocell, exceeds a certain limiting value.

This method has also proven worthwhile in specific applications. Unfortunately, there is solid matter that causes the photocell to become blind over time, so that in these cases satisfactory control of the separator is no longer ensured. There is therefore a need for simple and nevertheless most precise methods for determining a moment that is highly suitable for the emptying of solid matter during the clarification of suspensions of solid matter by using discontinuously automatically emptying separators.

Exemplary embodiments of the present invention provide a method for continuously clarifying a free-flowing suspension or a free-flowing product with a centrifuge, in particular a separator—an automatically emptying separator—that discontinuously automatically empties solid matter and comprises a rotatable drum having a vertical axis of rotation, having an inlet for the suspension to be clarified and at least one liquid discharge for the continuous discharge of at least one clarified liquid phase and solid-matter discharge openings that are to be opened discontinuously for the discontinuous discharge of the solid phase. The method involves: a) measuring one or more of the suspension parameters comprising mass, mass of solid matter in suspension, mass flow, temperature, density, cumulative density; and b) initiating a time-limited solid-matter discharge as a result of a repeated determination according to step b) upon reaching or after exceeding a limiting value dependent on one or more of the measured suspension parameters.

The limiting value can be one that can be (preferably) determined directly from the behavior over time of the one or more suspension parameters. However, it can also be a limiting value that can be determined from the first (or second or nth) derivative of the behavior over time of the one or more suspension parameters, for example in the form of a differential ratio of the measured values of the suspension parameter and the time intervals between the measurements of the suspension parameter.

The direct or indirect determination of one or two or more of the aforementioned parameters makes it possible to determine the mass of solid matter (or value proportional thereto) in each case that has been separated from the suspension since the last emptying, in order to draw conclusions about the level of filling of the solid-matter chamber with solid matter separated out from the suspension, which has collected in the solid-matter collecting chamber. In particular, the solid matter must not reach the edge of the disk stack. If, therefore, the mass of solid matter value determined exceeds a predefined limiting value—for example determined during trial operation—emptying is initiated in order to empty the solid-matter collecting chamber entirely of solid matter or in any case to the greatest possible extent.

To determine the suspension and/or mass of solid matter, a Coriolis flowmeter is in particular suitable, with which a sufficiently accurate determination of this value or these values is possible in a straightforward manner. The Coriolis flowmeter is preferably designed to measure the mass flow, the density and the cumulative density in parallel. It preferably also measures the temperature. Cumulative density means that the density is measured again and again at time intervals, that the sum of these values is formed (directly or suitably processed further, e.g. multiplied by the time interval between the measurements) and thus a value directly corresponding to the mass of solid matter is determined.

If the suspension to be processed has a relatively uniform, constant proportion of solid matter, it may be sufficient for the mass determination to determine the mass flow per unit time of incoming suspension and to integrate the same over time, in particular by means of addition, in order therefrom to determine by computation the proportion of solid matter that has collected in the solid-matter collecting chamber. However, if the proportion fluctuates, it may be necessary, with the aid of a previously stored table—e.g. determined in trials—or with the aid of a previously determined functional relationship and the measurement of a further suspension parameter such as the density, to determine in each case how high the proportion of solid matter in the incoming suspension is at present, which is possible with modern Coriolis flowmeters. With an additional temperature determination, which the Coriolis flowmeter can preferably likewise also carry out in an integrated manner, and with a supplementary accumulation of the measured values—which is preferably likewise carried out directly by the Coriolis flowmeter/sensor, the level of filling of the solid-matter collecting chamber of the drum can be determined.

At the same time, the Coriolis flowmeter (Coriolis meter) can be used to protect the automatically emptying separator or the drum thereof against excessively high densities in the inlet, by the inlet being prevented (e.g. by controlling a valve) when the maximum permissible density for the respective automatically emptying separator is exceeded. This value is previously known and identified for each separator.

The individual method steps do not necessarily have to be carried out in a structural unit of the separator but can also be carried out by external devices (in particular measuring devices, sensors, control unit, individually or in combination therewith and possibly further devices).

BRIEF DESCRIPTION OF THE DRAWING FIGURES

Figure 2:
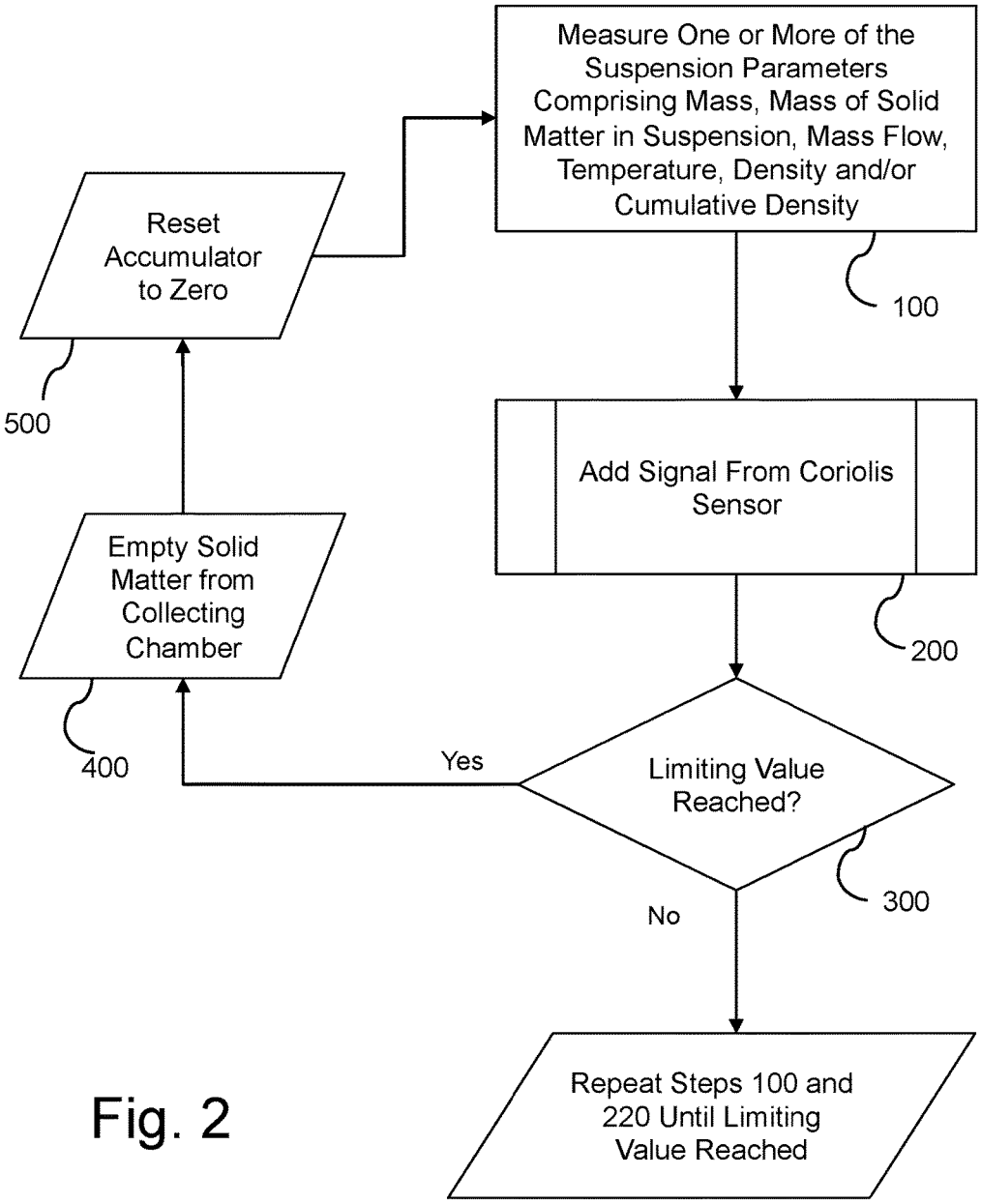

The invention will be explained in more detail below by using a preferred exemplary embodiment with reference to the appended drawings, in which:

FIG. 1: shows a schematic sectional view of a separator which is operated with the method according to the invention; and FIG. 2: shows a flowchart to illustrate a method according to the invention.

DETAILED DESCRIPTION

FIG. 1 shows a separator 1 for clarifying free-flowing starting suspensions SU containing turbid matter, having a rotatable drum with a vertical axis of rotation. The processing of the suspension is carried out in continuous operation. This means that the input of suspension is carried out continuously, as is the discharge of at least one clarified liquid phase, called the clear phase.

The automatically emptying separator has a discontinuous solid-matter discharge for this purpose, wherein the solid matter S separated from a suspension by clarification is emptied at intervals by opening and re-closing discharge nozzles or discharge openings 5.

The drum has a lower drum part 10 and a drum cover 11. It is also preferably surrounded by a hood 12. The drum is additionally placed on a drive spindle 2, which is rotatably mounted and can be motor-driven.

The drum has a suspension inlet 4, through which a suspension SU to be clarified is led into the drum. It also has at least one outlet 13 with a gripper, which is used to lead a clear phase L out of the drum. The gripper is a type of centripetal pump. However, the liquid discharge could also be managed with other means. In addition, it would also be conceivable, in addition to the clarification, to perform separation of the suspension into two liquid phases of different density. A further liquid outlet would be required for this purpose.

The drum preferably has a disk pack 14 made of axially spaced separating disks. Between the outer circumference of the disk pack 14 and the inner circumference of the drum, in the area of the greatest internal diameter of the latter, there is formed a solid-matter collecting chamber 8. Solid matter separated from the clear phase in the area of the disk pack 14 collects in the solid-matter collecting chamber 8, from which the solid matter can be discharged from the drum via the discharge openings 5. The discharge openings 5 can be opened and closed by means of a piston valve 6, which is arranged in the lower drum part 11. When the discharge openings are opened, the solid matter S is thrown out of the drum into a solid-matter collector 7.

To move the piston valve 6, the drum has an actuating mechanism. Here, this comprises at least one feed line 15 for a control fluid such as water and a valve arrangement 16 in the drum and further elements outside the drum. Thus, the input of the control fluid such as water is made possible by a control valve 17 arranged outside the drum, which is arranged in a feed line 19 for the control fluid that is arranged outside the drum, so that for an emptying action by opening the control valve, the control fluid can be sprayed into the drum or, vice versa, the inflow of control fluid can be interrupted in order to move the piston valve appropriately in order to open the discharge openings. The actuating mechanism—here the control valve 17—is connected via a data line 18 to a control unit 9 for controlling and/or regulating the solid-matter discharge.

A Coriolis sensor 20 is arranged in the inlet 4. The Coriolis sensor 20 is designed as a Coriolis mass flowmeter. The function of a Coriolis sensor designed as a Coriolis mass flowmeter is known per se. If a homogenous mixture of the solid-matter phase S and the liquid phase is present in the incoming suspension SU, via a density measurement, which can likewise be carried out by using the sensor 20, and intrinsically known fluid properties of the suspension, the two phases S and L can be determined proportionally. If necessary, these fluid properties can be determined in trials or in test operation.

The Coriolis sensor 20 is connected via a wired or wire-free data line 21 to the evaluation and control unit 9 (preferably a control computer of the separator), which evaluates the determined measured values and, on the basis of this evaluation, controls the emptying and therefore the opening of the discharge openings 5.

During the clarification of the suspension SU, forming the clear phase L, turbid matter contained in the suspension to be clarified and other solid matter is collected in the solid-matter collecting chamber 8 of the separator, which is filled. If too much of the solid matter is collected in the collecting chamber 8, the discharge thereof with the clear phase begins (FIG. 2), which should be avoided if possible.

In the following text, with reference to FIG. 2, an exemplary embodiment of a method according to the invention, which is carried out by means of the above-described separator, will be explained in more detail.

The suspension SU is preferably led continuously into the separator, in which said suspension is clarified. A continuing clear phase discharge of the clear phase L is carried out.

Arranged in the inlet 4 is the Coriolis sensor 20, with which, in a step 100, measures one or more of the suspension parameters comprising mass, mass of solid matter in suspension, mass flow, temperature, density and/or cumulative density. The signal from the Coriolis sensor 20 is added up in a step 200 by the control unit 9 of the separator or by electronics integrated into the Coriolis sensor. This cumulative value is stored temporarily in an accumulator in the sensor itself or preferably in the control unit.

Then, the cumulative value—preferably a mass value or a value proportional to the mass value—is compared in a step 300 with a predefined and previously stored limiting value. This predefined limiting value can, for example, have been determined previously during measurements in trial operation in such a way that it corresponds to an 80% filling of the solid matter collecting chamber with solid matter.

As long as a limiting value has not been reached, steps 100 and 200 are repeatedly run through again (indicated by the downward arrow by the "300").

On the other hand, when the limiting value is reached or exceeded, in a step 400 the piston valve is actuated to empty the solid matter from the collecting chamber. In a step 500, the accumulator is set back to zero and a measurement according to step 100 and an accumulation of the measured values in the accumulator according to step 200 are repeatedly started again until a renewed emptying action.

LIST OF DESIGNATIONS

1 Separator
2 Spindle
4 Inlet
5 Discharge openings
6 Piston valve
7 Solid-matter collector
8 Solid-matter collecting chamber
9 Evaluation unit
10 Lower drum part
11 Drum cover
12 Hood
13 Outlet

14 Disk pack
15 Line for hydraulic fluid
16 Valve
17 Control valve
18 Data line
19 Hydraulic line
20 Sensor
21 Data line
SU Suspension
L Liquid phase/clear phase
Solid matter

The invention claimed is:

1. A method, comprising:

a) continuously clarifying a free-flowing suspension with a centrifuge, wherein the centrifuge discontinuously empties solid matter via openable and closeable solid-matter discharge openings, and comprises a rotatable drum with a vertical axis of rotation, an inlet for receiving the suspension to be clarified, and at least one liquid discharge for continuous discharge of at least one clarified liquid phase;

b) measuring one or more of suspension parameters comprising mass, mass of solid matter in suspension, mass flow, temperature, density, cumulative density; and c) initiating a time-limited solid-matter discharge as a result of a repeated determination according to step b) upon reaching or after exceeding a limiting value dependent on one or more of the measured suspension parameters, wherein the time-limited solid-matter discharge comprises opening and then closing the solid-matter discharge openings of the centrifuge to discharge the solid matter, wherein a Coriolis flowmeter, with which a mass flow is determined, determines the one or more of the suspension parameters of the step b), and wherein the measured results from the Coriolis flowmeter protect the centrifuge or a drum of the centrifuge from excessively high densities in the inlet, by preventing feeding of the suspension to be clarified to the inlet when a maximum permissible density of the separator is exceeded.

2. The method of claim 1, wherein the solid-matter mass value or a value proportional to the solid-matter mass value of the solid matter that has been separated from the suspension since the last emptying is determined to determine level of filling of a solid matter chamber of the centrifuge with the solid matter separated from the suspension.

3. The method of claim 1, further comprising:

integrating an output signal from the Coriolis flowmeter over time, wherein the initiation of the discharge is performed based on the integrated output signal.

4. The method of claim 3, wherein the integration over time is carried out by accumulating measured values, and the limiting value is a cumulative limiting value.

5. The method claim 1, wherein the free-flowing suspension has a fluctuating solid-matter content.

6. The method of claim 1, wherein the centrifuge is a separator.

7. The method of claim 1 wherein the centrifuge is an automatically emptying separator.

* * * * *